US009493985B2

(12) United States Patent
Weir et al.

(10) Patent No.: US 9,493,985 B2
(45) Date of Patent: Nov. 15, 2016

(54) MUD HYDRAULIC TOP DRIVE

(71) Applicant: National Oilwell Varco, L.P., Houston, TX (US)

(72) Inventors: James William Weir, Houston, TX (US); Dean A. Bennett, Missouri City, TX (US)

(73) Assignee: National Oilwell Varco, L.P., Houston, TX (US)

( * ) Notice: Subject to any disclaimer, the term of this patent is extended or adjusted under 35 U.S.C. 154(b) by 557 days.

(21) Appl. No.: 13/948,758

(22) Filed: Jul. 23, 2013

(65) Prior Publication Data

US 2015/0027782 A1 Jan. 29, 2015

(51) Int. Cl.

| | |
|---|---|
| ***E21B 4/02*** | (2006.01) |
| ***E21B 3/02*** | (2006.01) |
| ***E21B 21/00*** | (2006.01) |

(52) U.S. Cl.

CPC . *E21B 4/02* (2013.01); *E21B 3/02* (2013.01); *E21B 21/00* (2013.01)

(58) Field of Classification Search

None

See application file for complete search history.

(56) References Cited

U.S. PATENT DOCUMENTS

| | | | | |
|---|---|---|---|---|
| 6,050,348 | A | 4/2000 | Richarson | |
| 2009/0151934 | A1* | 6/2009 | Heidecke | E21B 3/02 166/250.01 |
| 2011/0280104 | A1* | 11/2011 | McClung, III | E21B 3/02 367/82 |
| 2012/0024539 | A1* | 2/2012 | Lehr | E21B 7/068 166/381 |
| 2013/0118811 | A1 | 5/2013 | Fagg | |
| 2014/0166363 | A1* | 6/2014 | Haci | E21B 44/00 175/24 |

FOREIGN PATENT DOCUMENTS

| | | |
|---|---|---|
| GB | 2344121 | 5/2000 |
| WO | 2013052165 | 4/2013 |

OTHER PUBLICATIONS

Search Report and Written Opinion dated Dec. 12, 2014 for corresponding International Application No. PCT/US2014/046493 (77 pgs.).

* cited by examiner

*Primary Examiner* — Jennifer H Gay
*Assistant Examiner* — Caroline Butcher
(74) *Attorney, Agent, or Firm* — Derek V. Forinash; Porter Hedges LLP

(57) ABSTRACT

A top drive includes a hydraulic motor in fluid communication with first inlet for a supply of pressurized drilling fluid. A drill string adapter is mechanically coupled to the hydraulic motor and is in fluid communication with the first inlet.

18 Claims, 6 Drawing Sheets

MUD HYDRAULIC TOP DRIVE

CROSS-REFERENCE TO RELATED APPLICATIONS

None

BACKGROUND

This disclosure relates generally to top drive systems and methods for operating a top drive to drill a wellbore. More specifically, this disclosure relates to top drive systems that utilize hydraulic motors to provide the torque needed to rotate a drill string.

A top drive is a system that is suspended in a derrick and used to support and rotate a drill string as well as provide a conduit for the supply of pressurized drilling fluid to the drill string. A conventional top drive system includes an electric or hydraulic motor that is coupled to a drill string. In many systems, the motor is coupled to a transmission, or other gearing, and a short section of pipe, known as a quill. The quill is often coupled to the drill string by a saver sub or may be directly coupled to the upper end of the drill string.

The quill is also in fluid communication with a gooseneck, or other piping, that provides a fluid conduit for the supply of pressurized drilling fluid, or drilling mud, from the rig's mud pumps to the drill string. The drilling fluid flows through the drill pipe and into the wellbore, providing critical functions including, cooling and lubrication of the drill bit, control of wellbore pressures, and cleaning of the wellbore. Drilling fluids are often relatively high density fluids containing suspended solids and other materials designed to improve the drilling process.

Advances in drilling technology have enabled wellbores to be drilled at extreme depths and with the use of long horizontal sections. Both of these types of wellbores necessitate the use of long drill strings. As the length of the drill string increases, the power requirements of the top drive also increases. This need for increased power has been addressed by using multiple motors and/or by increasing the size of the motors being used. As the motors increase in size and/or number the size of the top drive also increases and the supply of power to the top drive motor(s) becomes increasingly challenging. The space available for a top drive is limited by the size of the derrick and high power motors often means larger sized motors.

For top drives with high-power electric motors, additional electrical generators may be needed. Additionally, the cables that supply electric power to the top drive can be prohibitively expensive and cumbersome to manage. Similarly, top drives that utilize hydraulic motors are supplied with dedicated hydraulic power units (including a fluid supply, pump, and power generator). As the power requirements of the top drive increases so do the power requirements, and likely the physical size, of the hydraulic power unit. This can also be problematic on drilling rigs where space is limited.

Thus, there is a continuing need in the art for top drive systems, and methods for operating top drive systems, that address at least some of the issues discussed above.

BRIEF SUMMARY OF THE DISCLOSURE

A top drive comprises a hydraulic motor in fluid communication with first inlet for a supply of pressurized drilling fluid. A drill string adapter is mechanically coupled to the hydraulic motor and is in fluid communication with the first inlet. In certain embodiments, the top drive includes a second inlet for the supply of pressurized drilling fluid. In certain embodiments, the hydraulic motor is in fluid communication with the first and second inlets. In certain embodiments, the top drive includes a mixing chamber in fluid communication with the second inlet and with the drill string adapter. In certain embodiments, the top drive includes a plurality of flow control devices operable to control the supply of pressurized drilling fluid from the first inlet to the hydraulic motor. In certain embodiments, the top drive includes a sensor for measuring characteristics of the pressurized drilling fluid.

In other embodiments, a drilling system includes a top drive system with a hydraulic motor that is hydraulically coupled to a mud pump. A drill string is mechanically coupled to the hydraulic motor and hydraulically coupled to the mud pump. In certain embodiments, the drilling system includes a first fluid conduit that couples the mud pump to a first inlet of the top drive system. In certain embodiments, the drilling system includes a second fluid conduit that couples the mud pump to a first inlet of the top drive system. In certain embodiments, the hydraulic motor is hydraulically coupled to the first and second inlets. In certain embodiments, the top drive system further includes a mixing chamber that is hydraulically coupled to the second inlet and to the drill string. In certain embodiments, the drilling system includes a plurality of flow control devices operable to control fluid flow from the mud pump to the hydraulic motor. In certain embodiments, the drilling system includes a control system operable to regulate the mud pump and the plurality of flow control devices.

In some embodiments, a method of operating a top drive system includes operating a mud pump to provide a pressurized drilling fluid; supplying the pressurized drilling fluid to a top drive system; passing at least a portion of the pressurized drilling fluid through a hydraulic motor that is mechanically coupled to a drill string; and passing the pressurized drilling fluid to the drill string. In certain embodiments, the method also includes measuring one or more fluid characteristics of the pressurized drilling fluid that is passed to the drill string. In certain embodiments, the method also includes regulating the mud pump or the hydraulic motor in response to the measured fluid characteristic. In certain embodiments, the method also includes regulating the mud pump or the hydraulic motor in response to a pressure input or a rotation input. In certain embodiments, all of the pressurized drilling fluid is passed through the hydraulic motor before being passed to the drill string. In certain embodiments, the pressurized drilling fluid is combined with a second supply of pressurized drilling fluid before being passed to the drill string. In certain embodiments, the pressurized drilling fluid is supplied to the top drive system through a first and second inlet, wherein the pressurized drilling fluid is supplied to first inlet at a different pressure than the pressurized drilling fluid supplied to the second inlet.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
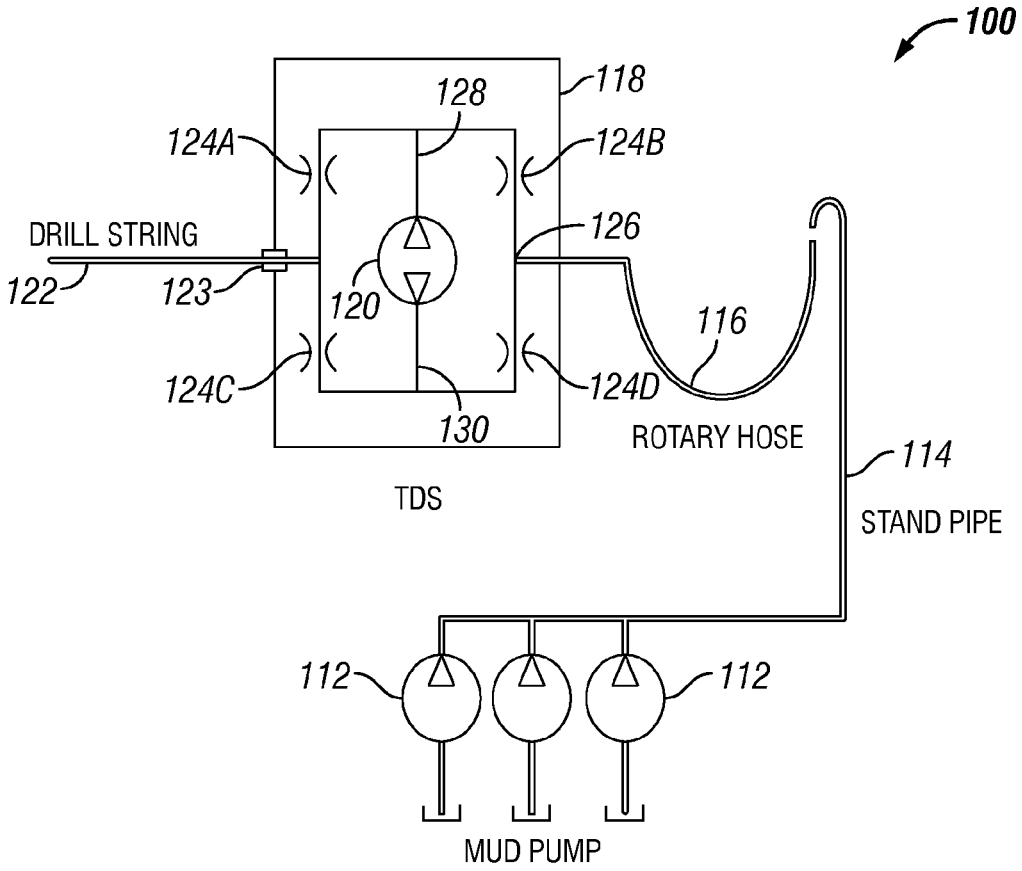
FIG. 1 is schematic diagram of a hydraulic top drive system.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring initially to FIG. 1, a drilling system 100 includes one or more mud pumps 112 that supply pressurized drilling fluid through a stand pipe 114 and rotary hose 116 to a first inlet 126 of a top drive system 118. The top drive system 118 includes a hydraulic motor 120 that is in fluid communication, or hydraulically coupled, with the first inlet 126. The top drive system 118 includes a plurality of flow control devices 124A-124D, such as valves or chokes, which regulate the flow of drilling fluid to the hydraulic motor 120. The hydraulic motor 120 utilizes the pressurized drilling fluid to generate torque that is transferred to a drill string 122 via a drill string adapter, or quill, 123 that is mechanically coupled to the motor 120. The drill string adapter 123 is also in fluid communication with the first inlet 126 so as to pass pressurized drilling fluid to the drill string 122. Thus, the top drive system 118 utilizes the pressurized drilling fluid from mud pumps 112 to power the hydraulic motor 120 and provide drilling fluid to the drill string 122.

In operation, pressurized drilling fluid is supplied by mud pumps 112 to the top drive system 18 via the stand pipe 114 and rotary hose 116. The rotary hose 116 couples to the top drive system 118 at fluid inlet 126. Flow control devices 124A-124D are operable to divide the flow of drilling fluid between fluid conduit 128 and 130. Flow control devices 124A-124D can be adjusted to divide the drilling fluid between the fluid conduits 128, 130 so as to create a pressure differential across hydraulic motor 120. For example, maintaining a higher pressure in fluid conduit 128 than in fluid conduit 30 will result in fluid passing through the hydraulic motor 120 from fluid conduit 128 to fluid conduit 130. A plurality of flow control devices, such as valves or chokes, 124A-124D are also operable to control the pressure and flow rate of drilling fluid that is passed through fluid outlet 132 to the drill string 122.

Figure 2:
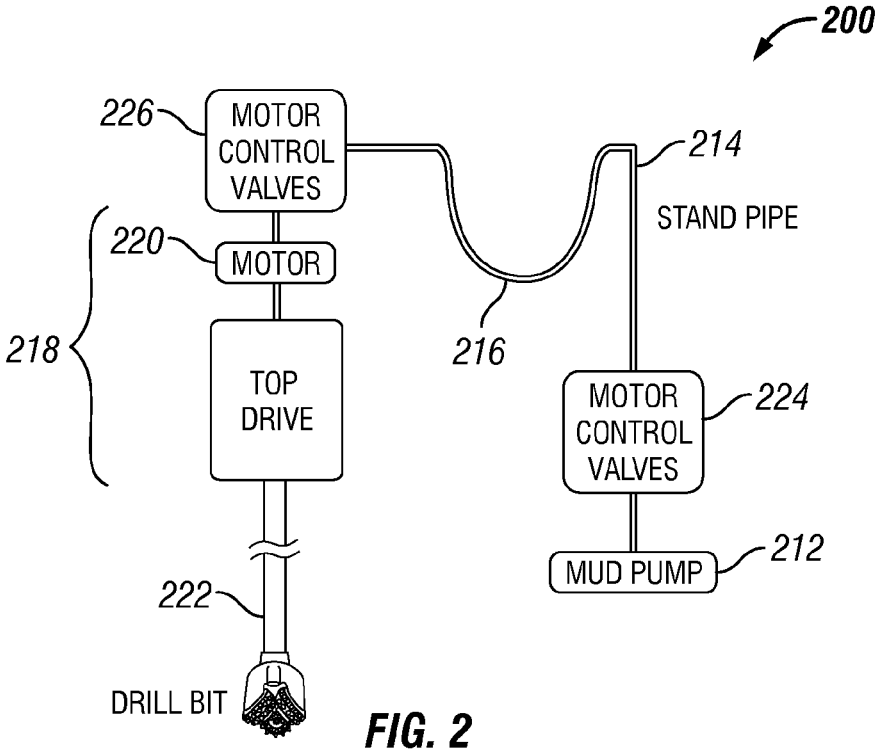
FIG. 2 is a partial schematic diagram of a top drive control system.
Figure 3:
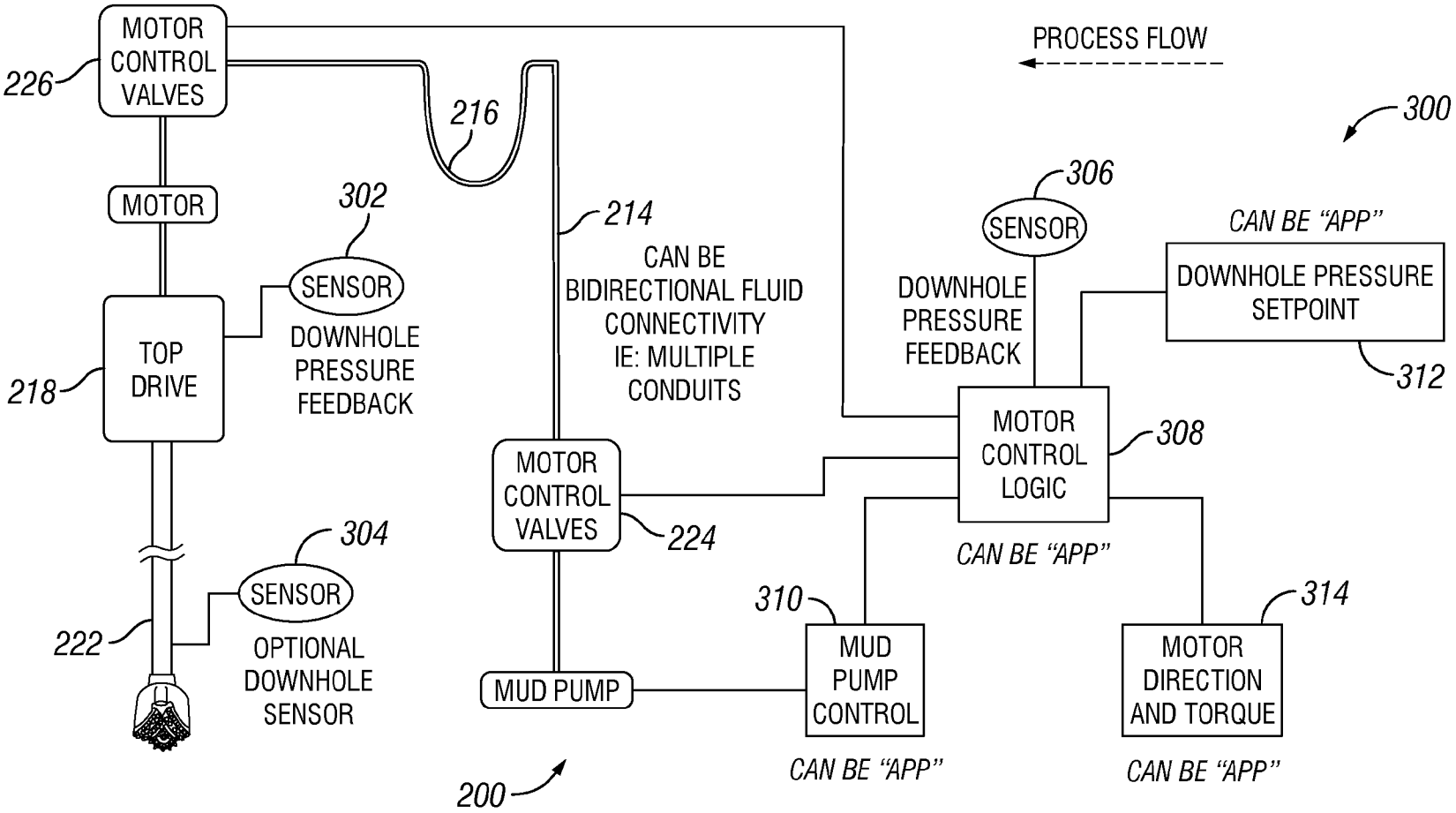
FIG. 3 is a partial schematic diagram of a top drive control system.

Referring now to FIGS. 2 and 3, a drilling system 200 includes one or more mud pumps 212 that supply pressurized drilling fluid through a stand pipe 214 and rotary hose 216 to a top drive system 218 including motor 220. The top drive system 218 supports and supplies pressurized drilling fluid to a drill string 222 that is rotated by the motor 220. Motor control valves 224 and 226 control the flow of pressurized fluid to the top drive system 218 and motor 220.

The pressurized fluid supplied by the mud pumps 212 provides both the fluid energy to power the motor 220 and supply the drill string 222 with drilling fluid having the flow rate, density, and pressure necessary to perform drilling operations. In order to meet both of these needs, a control system 300 may include top drive sensors 302, downhole sensors 304, mud return sensors 306, drilling controller 308, mud pump controller 310, bottomhole pressure data input 312, and drill string rotation input 314. The controllers 308, 310 and the inputs 312, 314 may be standalone systems or may be integrated into a drilling control system such as that described in WO 2013/052165, titled Automatic Drilling System, which is incorporated by reference herein for all purposes.

Top drive sensors 302 may be integrated into the top drive system 218 and may be configured to measure characteristics of the drilling fluid at one or more locations in the top drive system 218. For example, one or more sensors 302 may measure the pressure and flow rate of fluid entering the drill string 222 as well as the differential pressure across the motor 220. Downhole sensors 304 may measure drilling fluid characteristics at or near the drill bit, or at other locations in the drill string 222. Mud return sensors 306 may be operable to measure the pressure and flow rate of drilling fluid that is returned from the wellbore.

In operation, the desired bottomhole pressure characteristics and drill string rotation characteristics are entered via inputs 312 and 314 respectively, by a system operator or other drilling control system. That data is communicated to the drilling controller 308, which analyzes the fluid characteristics measured by sensors 302, 304, and 306 in order to determine the required operating parameters of the mud pumps 212 and the motor 220. The drilling controller 308 then issues instructions to the motor control valves 224 and 226 as well as mud pump controller 310 to regulate the supply of drilling fluid to the top drive system 218. Control system 300 can operate in a continuous feedback mode where continuous adjustments are made in response to data received from the sensors.

Figure 4:
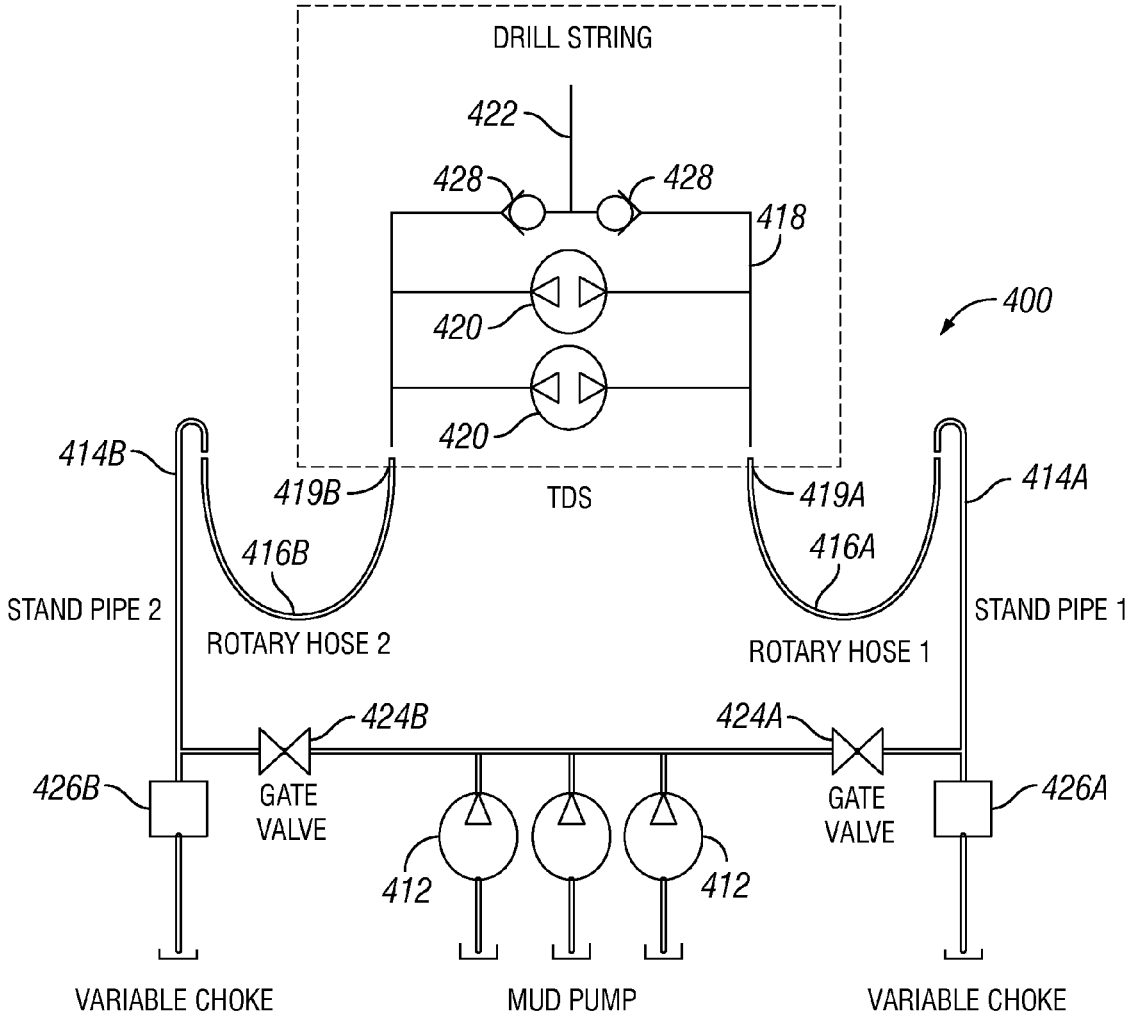
FIG. 4 is schematic diagram of a hydraulic top drive system.
Figure 7A:
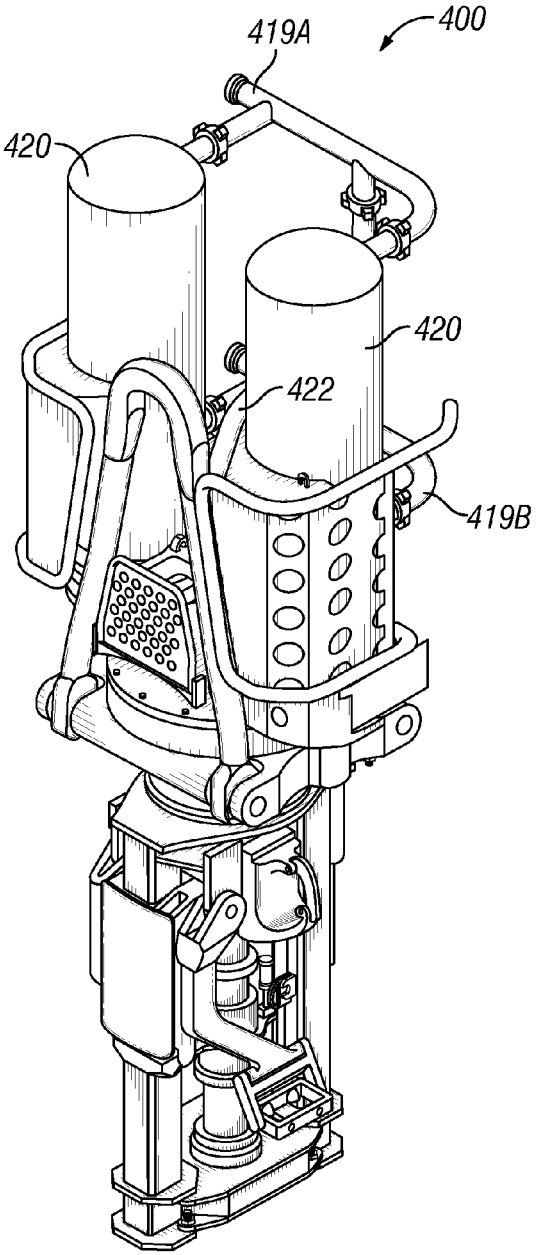
FIGS. 7A and 7B are partial isometric views of the top drive system of FIG. 4.
Figure 7B:
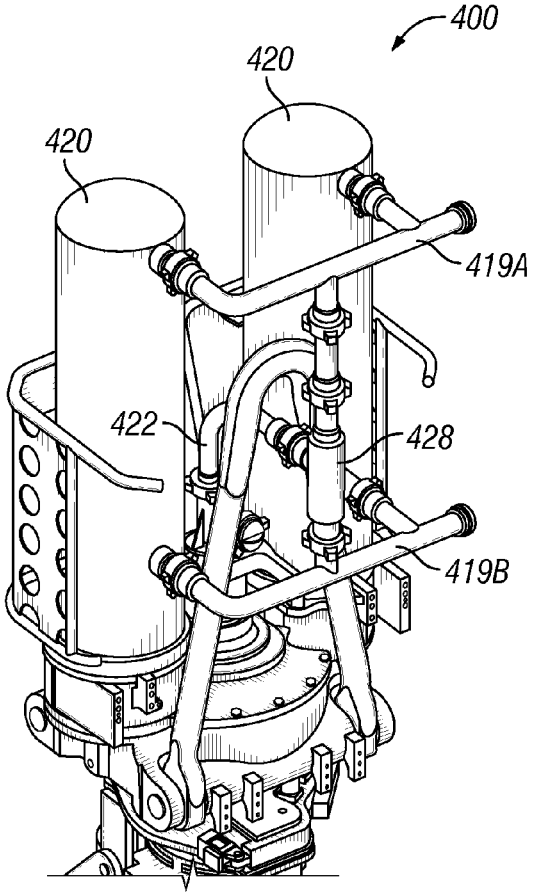

Referring now to FIGS. 4 and 7A-B, a drilling system 400 includes one or more mud pumps 412 that supply pressurized drilling fluid through dual stand pipes 414A-B and rotary hoses 416A-B to first and second inlets 419A-B of a top drive system 418. The top drive system 418 utilizes the pressurized drilling fluid to operate one or more hydraulic motors 420 and supplies pressurized drilling fluid to a drill string 422. Valves 424 and/or chokes 426 can be used to independently regulate the pressure and flow rate through each stand pipe 414A-B and rotary hose 416A-B. In this manner, the flow rate and pressure of drilling fluid supplied to the top drive system 418 by rotary hose 416A can be controlled separately from the flow rate and pressure of drilling fluid supplied to the top drive system 418 by rotary hose 416B. This creates a pressure differential across the hydraulic motors 420 that can be regulated to control the speed and direction of rotation of the motors 420. Check valves 428 prevent fluid from moving from the drill string 422 into the top drive system 418.

Figure 5:
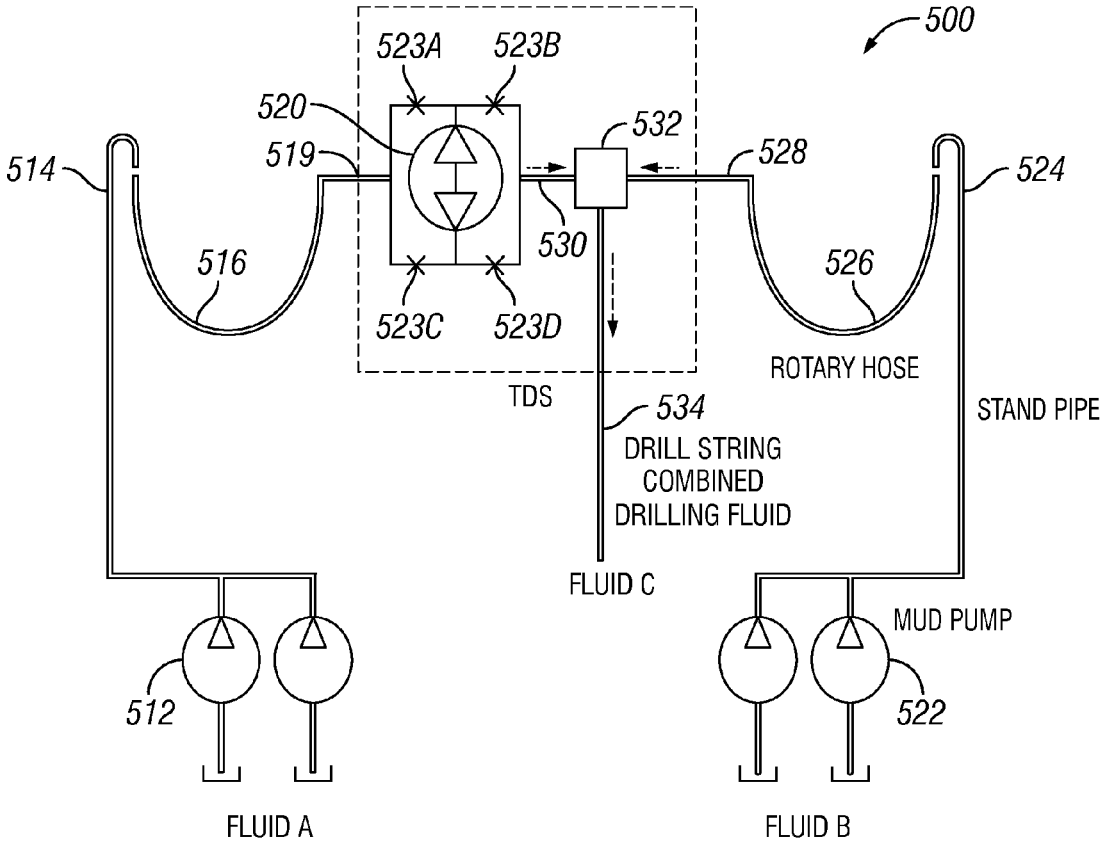
FIG. 5 is schematic diagram of a hydraulic top drive system.

Referring now to FIG. 5, a drilling system 500 includes one or more mud pumps 512 that supply a first pressurized drilling fluid through a stand pipe 514 and rotary hose 516 to a top drive system 518. The rotary hose 516 is coupled to a first inlet 519 that supplies the drilling fluid to a hydraulic motor 520. A second set of one or more mud pumps 522 supply a second pressurized drilling fluid through a stand pipe 524 and rotary hose 526 to the top drive system 518 via a second fluid inlet 528. Valves 523A-D control the flow of drilling fluid to the hydraulic motor 520. The second fluid inlet 528 and an outlet 530 from the hydraulic motor 520 are coupled to a mixing chamber 532 where the first and second pressurized drilling fluids are mixed before being sent to a drill string 534 as a combined drilling fluid. The first and second pressurized drilling fluids may have different physical properties, such as density, lubricity, viscosity, etc., or may be pumped at different pressures and/or flow rates as desired to operate the hydraulic motor 520 and provide downhole fluid functions. The drilling fluid supplied to mud pumps 512 and 522 may be drawn from the same supply of drilling fluid. In certain embodiments, mud pumps 512 may draw drilling fluid from a different supply than that of mud pumps 522.

Figure 6:
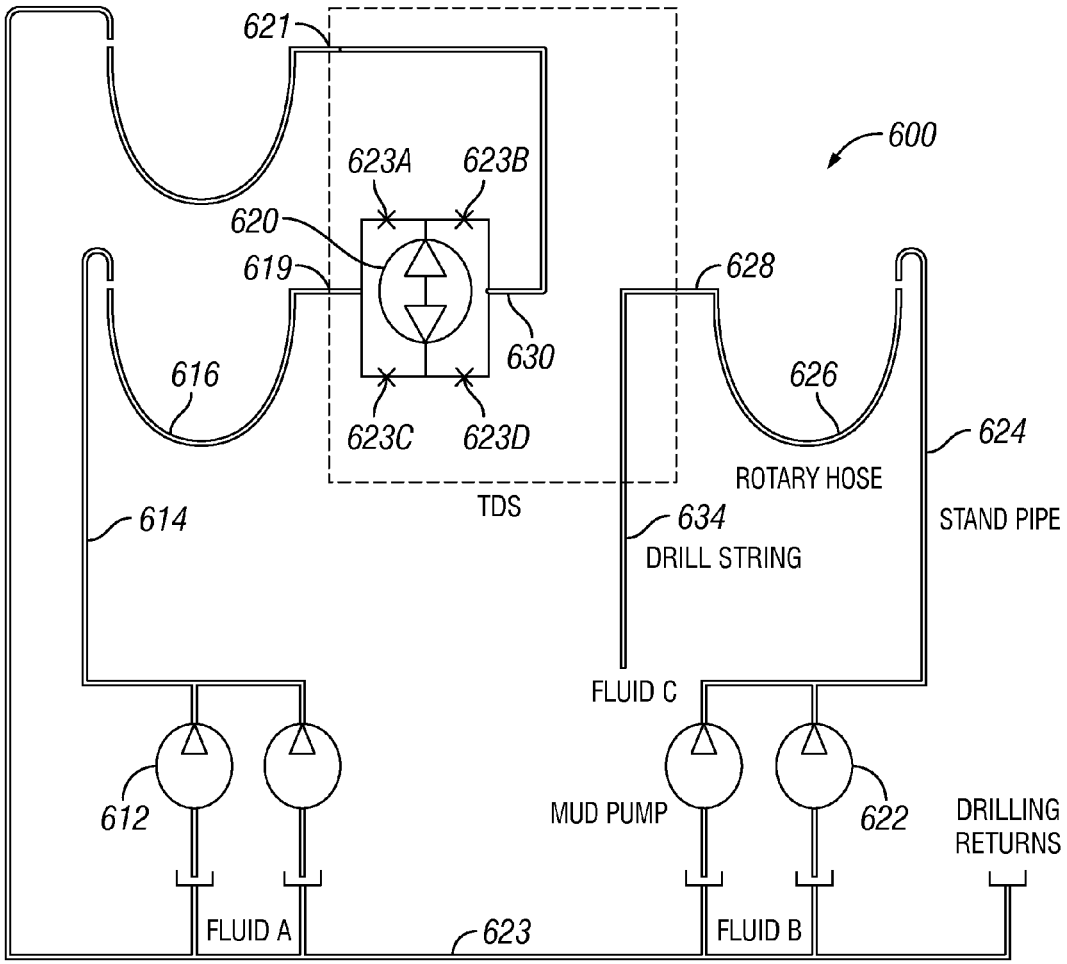
FIG. 6 is schematic diagram of a hydraulic top drive system.

Referring now to FIG. 6, a drilling system 600 includes one or more mud pumps 612 that supply a first pressurized drilling fluid through a stand pipe 614 and rotary hose 616 to a top drive system 618. The rotary hose 616 is coupled to a first fluid inlet 619 that supplies the drilling fluid to a hydraulic motor 620. A first fluid outlet 621 returns drilling fluid from the hydraulic motor 620 to drilling fluid reservoir 623. A second set of one or more mud pumps 622 supply a second pressurized drilling fluid through a stand pipe 624 and rotary hose 626 to the top drive system 618 via a second fluid inlet 628 that supplies drilling fluid to a drill string 634. The first and second pressurized drilling fluids may have different physical properties, such as density, lubricity, viscosity, etc., or may be pumped at different pressures and/or flow rates as desired to operate the hydraulic motor 620 and provide downhole fluid functions. The drilling fluid supplied to mud pumps 612 and 622 may be drawn from the same supply of drilling fluid. In certain embodiments, mud pumps 612 may draw drilling fluid from a different supply than that of mud pumps 622.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A top drive comprising:
a first inlet for a supply of pressurized drilling fluid;
a hydraulic motor in fluid communication with the first inlet;
a drill string adapter mechanically coupled to the hydraulic motor, wherein the drill string adapter is in fluid communication with the first inlet;
a second inlet for the supply of pressurized drilling fluid; and
a mixing chamber in fluid communication with the second inlet and with the drill string adapter.

2. The top drive of claim 1, further comprising a second inlet for the supply of pressurized drilling fluid.

3. The top drive of claim 2, wherein the hydraulic motor is in fluid communication with the first and second inlets.

4. The top drive of claim 1, further comprising a plurality of flow control devices operable to divide the supply of pressurized drilling fluid from the first inlet between two conduits coupled to the hydraulic motor.

5. The top drive of claim 4, further comprising a sensor for measuring characteristics of the pressurized drilling fluid, the sensor communicating with a drilling controller that operates at least one of the plurality of flow control devices.

6. The top drive of claim 1, further comprising a fluid conduit that couples the hydraulic motor to the drill string adapter.

7. A drilling system comprising:
a mud pump;
a top drive system hydraulically coupled to the mud pump, wherein the top drive system includes a hydraulic motor that is hydraulically coupled to the mud pump;
a drill string coupled to the top drive system, wherein the drill string is mechanically coupled to the hydraulic motor and hydraulically coupled to the mud pump;
a first fluid conduit that couples the mud pump to a first inlet of the top drive system; a second fluid conduit that couples the mud pump to a second inlet of the top drive system, wherein the hydraulic motor is hydraulically coupled to the first and second inlets; and
a mixing chamber that is hydraulically coupled to the second inlet and to the drill string.

8. The drilling system of claim 7, further comprising a first fluid conduit that couples the mud pump to a first inlet of the top drive system.

9. The drilling system of claim 8, further comprising a second fluid conduit that couples the mud pump to a second inlet of the top drive system.

10. The drilling system of claim 9, wherein the hydraulic motor is hydraulically coupled to the first and second inlets.

11. The drilling system of claim 7, further comprising a plurality of flow control devices operable to control fluid flow from the mud pump to the drill string and to create a pressure differential across the hydraulic motor.

12. The drilling system of claim 11, further comprising a control system operable to regulate the mud pump and the plurality of flow control devices.

13. A method of operating a top drive system comprising:

operating a mud pump to provide a pressurized drilling fluid;

supplying the pressurized drilling fluid to a top drive system;

passing at least a portion of the pressurized drilling fluid through a hydraulic motor that is mechanically coupled to a drill string; and passing the pressurized drilling fluid to the drill string, wherein the pressurized drilling fluid is combined with a second supply of pressurized drilling fluid before being passed to the drill string.

14. The method of claim 13, further comprising measuring one or more fluid characteristics of the pressurized drilling fluid that is passed to the drill string and regulating the hydraulic motor in response to the measured fluid characteristic.

15. The method of claim 14, further comprising regulating the mud pump in response to the measured fluid characteristic.

16. The method of claim 14, further comprising regulating the mud pump or the hydraulic motor in response to a pressure input or a rotation input.

17. A method of operating a top drive system comprising:

operating a mud pump to provide a pressurized drilling fluid;

supplying the pressurized drilling fluid to a top drive system;

passing at least a portion of the pressurized drilling fluid through a hydraulic motor that is mechanically coupled to a drill string; and passing the pressurized drilling fluid to the drill string, wherein the pressurized drilling fluid is supplied to the top drive system through a first and second inlet, wherein the pressurized drilling fluid is supplied to first inlet at a different pressure than the pressurized drilling fluid supplied to the second inlet.

18. The method of claim 17, wherein all of the pressurized drilling fluid is passed through the hydraulic motor before being passed to the drill string.

* * * * *